US005841401A

United States Patent [19]

Bodley et al.

[11] Patent Number: 5,841,401

[45] Date of Patent: Nov. 24, 1998

[54] PRINTED CIRCUIT ANTENNA

[75] Inventors: Martin R. Bodley, Sudbury; Michael G. Sarcione, Millbury; Fernando Beltran, Pramingham; Haywood Hartwell, Southboro, all of Mass.

[73] Assignee: Raytheon Company, Lexington, Mass.

[21] Appl. No.: 698,626

[22] Filed: Aug. 16, 1996

[51] Int. Cl.[6] ..... H01Q 1/38

[52] U.S. Cl. ..... 343/700 MS; 343/702; 343/872

[58] Field of Search ..... 343/700 MS, 702, 343/815, 817, 818, 853, 872

[56] References Cited

U.S. PATENT DOCUMENTS

| | | | |
|---|---|---|---|
| 3,761,936 | 9/1973 | Archer et al. | 343/754 |
| 3,947,850 | 3/1976 | Kaloi | 343/795 |
| 4,072,951 | 2/1978 | Kaloi | 343/700 |
| 4,074,270 | 2/1978 | Kaloi | 343/700 MS |
| 4,180,817 | 12/1979 | Sanford | 343/700 |
| 4,415,900 | 11/1983 | Kaloi | 343/700 MS |
| 4,686,535 | 8/1987 | Lalezari | 343/700 |
| 4,728,962 | 3/1988 | Kitsuda | 343/702 |
| 4,816,836 | 3/1989 | Lalezari | 343/700 |
| 4,835,538 | 5/1989 | McKenna et al. | 343/700 MS |
| 4,893,129 | 1/1990 | Kodera et al. | 343/700 |
| 4,907,006 | 3/1990 | Nishikawa et al. | 343/700 |
| 4,924,236 | 5/1990 | Schuss et al. | 343/700 |
| 4,937,585 | 6/1990 | Shoemaker | 343/700 MS |
| 5,008,681 | 4/1991 | Cavallaro et al. | 343/700 |
| 5,218,368 | 6/1993 | Huruno et al. | 343/700 MS |
| 5,231,407 | 7/1993 | McGirr et al. | 343/700 |
| 5,327,148 | 7/1994 | How et al. | 343/700 |
| 5,382,959 | 1/1995 | Pett et al. | 343/700 MS |
| 5,400,040 | 3/1995 | Lane et al. | 343/700 |
| 5,422,649 | 6/1995 | Huang | 343/700 MS |
| 5,506,591 | 4/1996 | Dienes | 343/818 |

FOREIGN PATENT DOCUMENTS

| | | | |
|---|---|---|---|
| 0096881 | 5/1987 | Japan | 343/700 MS |

OTHER PUBLICATIONS

Girish Kumar and Kuldip C. Gupta, Nonradiating Edges and Four Edges Gap–Coupled Multiple Resonator Broad–Band Microstrip Antennas, IEEE Transactions on Antennas and Propagation Vol. AP–33 No.2 Feb. 1985, pp. 173–178.

*Primary Examiner*—Don Wong
*Assistant Examiner*—Tan Ho
*Attorney, Agent, or Firm*—Nutter, McClennen & Fish, LLP

[57] ABSTRACT

An antenna includes a substrate having a first surface with a ground plane disposed thereover and having a second surface with a first plurality of strip conductors disposed along a first longitudinal axis thereof. A feed circuit has a first port coupled to an input port of the antenna and a plurality of second ports, each of which is coupled to one of the first plurality of strip conductors. A radome has a first surface disposed over and spaced a predetermined distance from the second surface of the substrate. A second plurality of strip conductors are disposed on the first surface of the radome above corresponding ones of the first plurality of strip conductors on the second surface of the substrate.

17 Claims, 7 Drawing Sheets

PRINTED CIRCUIT ANTENNA

FIELD OF THE INVENTION

This invention relates generally to radio frequency antennas and more particularly to printed circuit antennas.

BACKGROUND OF THE INVENTION

As is known in the art, existing cellular telephone and paging systems utilize signals having frequencies typically in the 800 to 900 megahertz (MHz) region of the ultrahigh frequency band (UHF). Such cellular telephone and paging services are typically provided by so-called cellular service providers. Cellular telephone and paging systems use a variety of antennas to satisfy particular coverage and gain requirements.

As is also known, there is a trend to develop a next generation cellular telephone service referred to as Personal Communication Services (PCS). The term PCS is often used to describe a wide range of activities and services including various wireless access services and personal mobility services having an emphasis on wireless access services. PCS systems utilize signals having frequencies which are different than the operating frequency range of existing cellular telephone and paging systems. For example, present PCS systems operate in a range of frequencies around 1900 MHZ.

PCS system specifications in the United States currently emphasize that PCS systems support of a wide range of wireless access services including cellular, micro-cellular and cordless telephone services, wireless data services and satellite based services. In the event that a cellular service provider having a license to send and receive signals in the cellular frequency range (e.g. 900 MHz) obtains a license to operate in the PCS frequency range (e.g. 1900 MHz), the service provider must add base station equipment and antennas responsive to signals in the PCS frequency range.

This results in some service provider locations having two physically separate antennas mounted in the same location. A first antenna would be responsive to signals in the cellular frequency range and a second antenna would be responsive to signals in the PCS frequency range.

One problem with this approach, however, is that it results in assembling, erecting and maintaining two physically separate antenna assemblies, two antenna mounting structures and two base stations. Another problem is that local zoning codes, building codes and aesthetic issues typically restrict the number and size of antenna assemblies erected by service providers.

It would therefore be desirable to provide a single antenna assembly which operates in two different frequency ranges such as the cellular and PCS frequency ranges. It would also be desirable to provide a relatively inexpensive antenna assembly which operates in two frequency bands and which allows the antenna characteristics of each antenna to be changed independently of one another. It would also be desirable to provide an antenna system which is relatively inexpensive to manufacture and which is responsive to signals in both the cellular and PCS frequency ranges and which allows service providers to use existing base station towers or buildings already having installed therein antennas responsive to signals from cellular and/or paging systems. It would also be desirable to provide an antenna system which can be assembled without screws or bolts.

SUMMARY OF THE INVENTION

In accordance with the present invention, an antenna includes a substrate having a first surface with a ground plane disposed thereover and a second surface having a first plurality of strip conductors disposed along a first longitudinal axis thereof. The antenna further includes a first feed circuit having a first port coupled to a first antenna port and having a plurality of second ports each of which are coupled to one of the plurality of strip conductors. A first surface of a radome is disposed over and spaced a pre-determined distance from the second surface of the substrate and a second plurality of strip conductors are disposed on the first surface of the radome. Each of the second plurality of strip conductors have a second pre-determined shape and are disposed along a first longitudinal axis of the radome wherein the first longitudinal axis of the radome is aligned with the first longitudinal axis of the substrate. With this particular arrangement, a printed circuit antenna is provided. The strip conductors disposed on the first surface of the substrate correspond to active antenna elements and the strip conductors disposed on the radome correspond to parasitic antenna elements disposed above the active antenna elements. Both the first and second plurality of strip conductors may be provided as microstrip circuits or so-called patch antenna elements disposed on respective surfaces of the antenna substrate and radome. The width of the parasitic antenna elements may be adjusted to modify the antenna beamwidth. Thus the antenna characteristics may be changed without changing the geometry of the active antenna elements. feed circuit may likewise be provided as a microstrip circuit disposed on the second surface of the substrate. The antenna may also include a back structure disposed against the first surface of the substrate. The back structure includes a mating region which engages a complementary mating region provided on the radome The mating region of the radome may be provided as clips, for example, which engage a wall of the back structure. In this manner, the antenna may be assembled by placing the substrate on a first one of the back structure and the radome and engaging the clips of the radome with the engagement region of the back structure. Thus, the antenna may be assembled without the aid of screws, rivets or other fastening means which require the use of tools or other devices. By placing antenna elements responsive to signals In accordance with the further aspect of the present invention, an antenna having first and second antenna ports includes a substrate having a first surface with the ground plane disposed thereover and having a second surface with a first and a second plurality of strip conductors disposed along respective ones of first and second longitudinal axes of the substrate. The antenna further includes first and second feed circuits. The first feed circuit has a first port coupled to the first antenna port and a plurality of second ports each of which is coupled to respective ones of the first plurality of strip conductors. Similarly, the second feed circuit has a first port coupled to the second antenna port and a plurality of second ports each of which is coupled to one of the second plurality of strip conductors. By providing the first and second plurality of antenna strip conductors with different geometries, this particular arrangement provides an antenna responsive to signals in first and second different frequency ranges. The first plurality of strip conductors corresponds to a first linear array of antenna elements and the second plurality of strip conductors corresponds to a second linear array of antenna elements. The antenna thus includes two nested linear arrays of antenna elements. The array antenna elements may be selected having a geometry such that the first linear array is responsive to signals having a frequency in a cellular telephone and paging system frequency range and the second linear array is responsive to signals having a frequency in a Personal Communication System (PCS) frequency range. The antenna elements of the linear arrays may be provided as microstrip patch antenna elements and the first and second feed circuits may be provided from reactive power dividers, all of which are provided as strip conductors disposed on a single substrate. A radome having first and second strip conductors disposed thereon to act as parasitic antenna elements may be placed over the two nested linear arrays of antenna elements. The geometry of the parasitic antenna elements can be changed to produce a change in antenna characteristics. For example, the beamwidth of each antenna may be changed by changing the width of the parasitic antenna elements disposed above the particular array. The gain and radiation patterns of each linear array can thus be independently controlled control for each of the linear antenna arrays. By combining two array antennas on a single substrate, the antenna simultaneously operates in both the cellular and PCS frequency ranges and fewer antenna assemblies are required at particular service provider sites which receive signals from both cellular and PCS systems. Furthermore, combining two arrays in a single antenna housing facilitates the addition of a PCS system to a site which already includes a cellular system. The antenna of the present invention also allows cellular service providers to utilize existing cellular infrastructure such as base station equipment, mounting structures, etc . . . .

BRIEF DESCRIPTION OF THE DRAWINGS

The foregoing features of the invention, as well as the invention itself may be more fully understood from the following detailed description of the drawings, in which.

DESCRIPTION OF THE PREFERRED EMBODIMENTS

Figure 1:
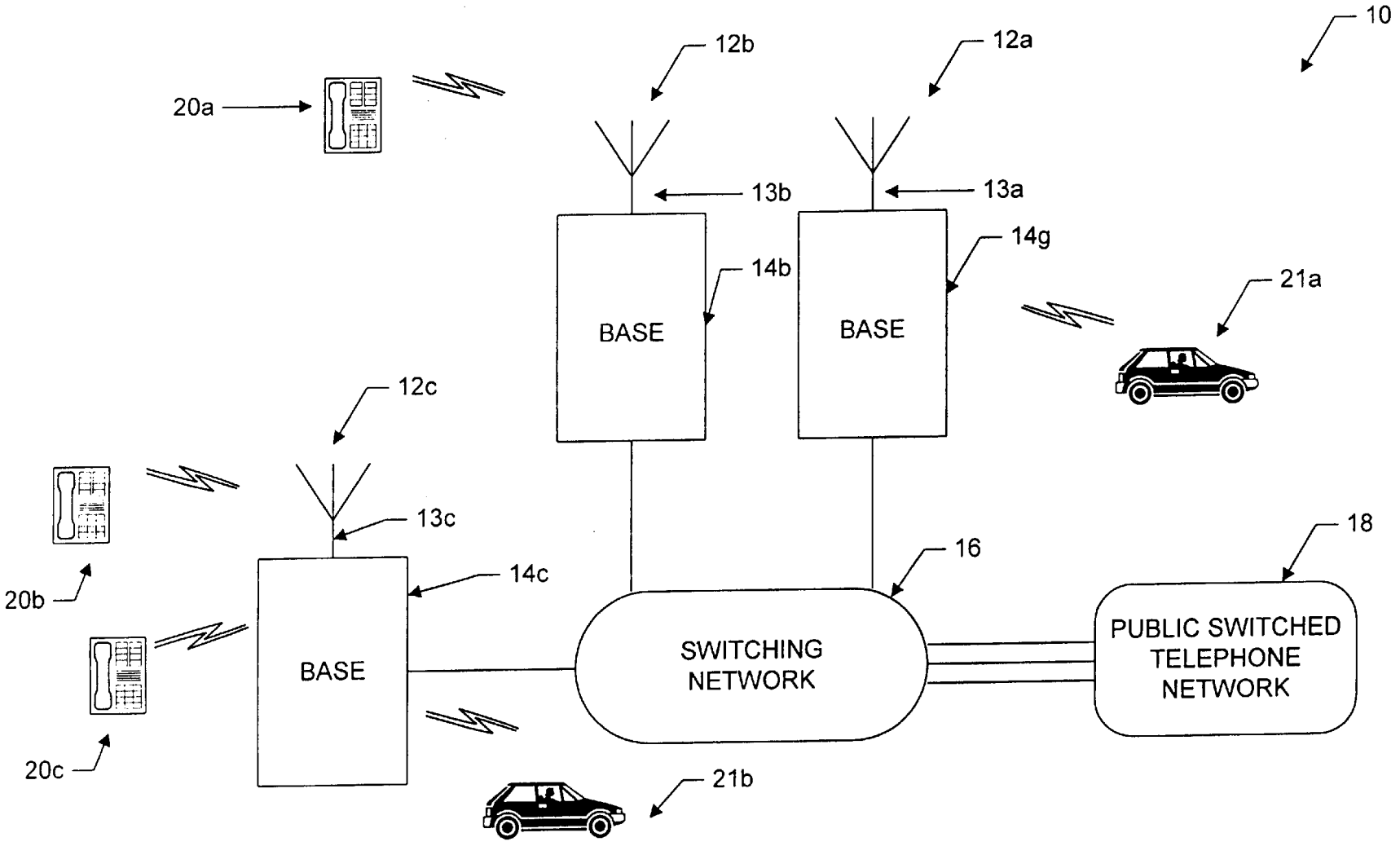
FIG. 1, is a block diagram of a cellular and Personal Communication Services 0 network architecture.

Referring now to FIG. 1, a cellular and Person Communication Services (PCS) network system 10 includes a plurality of antenna assemblies 12*a*–2*c* generally denoted 12, each coupled to one of a corresponding plurality of base stations 14*a*–14*c* generally denoted 14. Antenna assemblies 12 are responsive to signals propagating in the existing cellular telephone and paging frequency ranges 800–900 megahertz (MHZ) as well as to signals propagating in the Personal Communications Services (PCS) frequency range which typically is about 1900 MHZ.

As will be discussed further below in conjunction with FIGS. 2–6A, each of the antenna assemblies 12 is provided as a relatively low cost printed circuit antenna. Each of the antenna assemblies 12 is mounted on a base station mounting structure 13. The antennas 12 are coupled to base stations 14 which include transmit and receive equipment and interface circuits required to coupled signals to a central switching network 16.

Switching network 16 subsequently provides signals to a public switch telephone network (PSTN) 18 and to mobile users 21*a*, 21*b*. In a relatively simple cellular system, there is only one base station 14 per cell. Each base station 14 includes a transmitter/receiver which communicates directly with the users in its cell. Land lines couple signals from each base station 14 to the central switching network 16. Switching network 16 also includes circuitry to determine channel allocation and cell hand off as is generally known.

Figure 2:
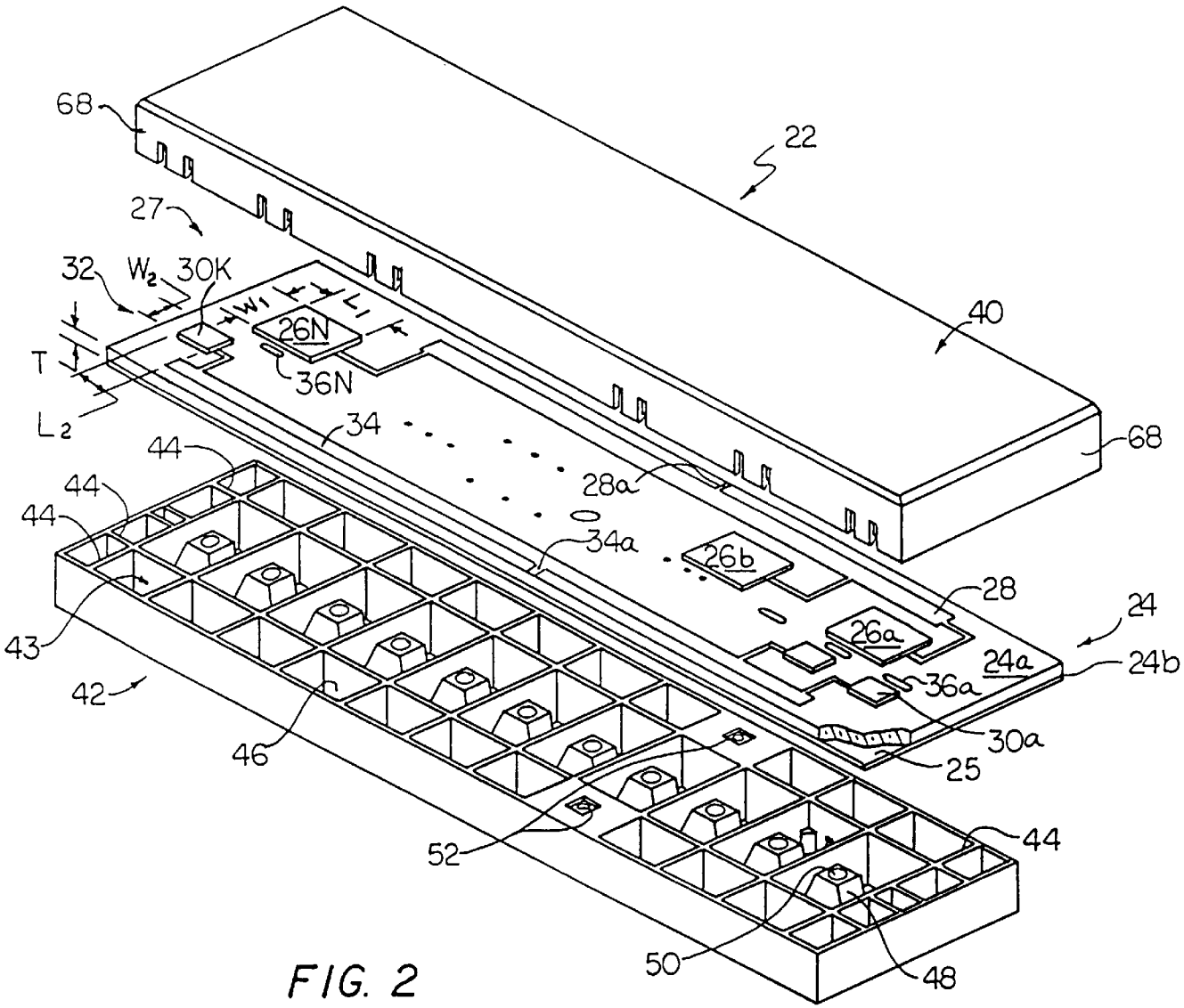
FIG. 2, is an exploded view of an antenna assembly.
Figure 3:
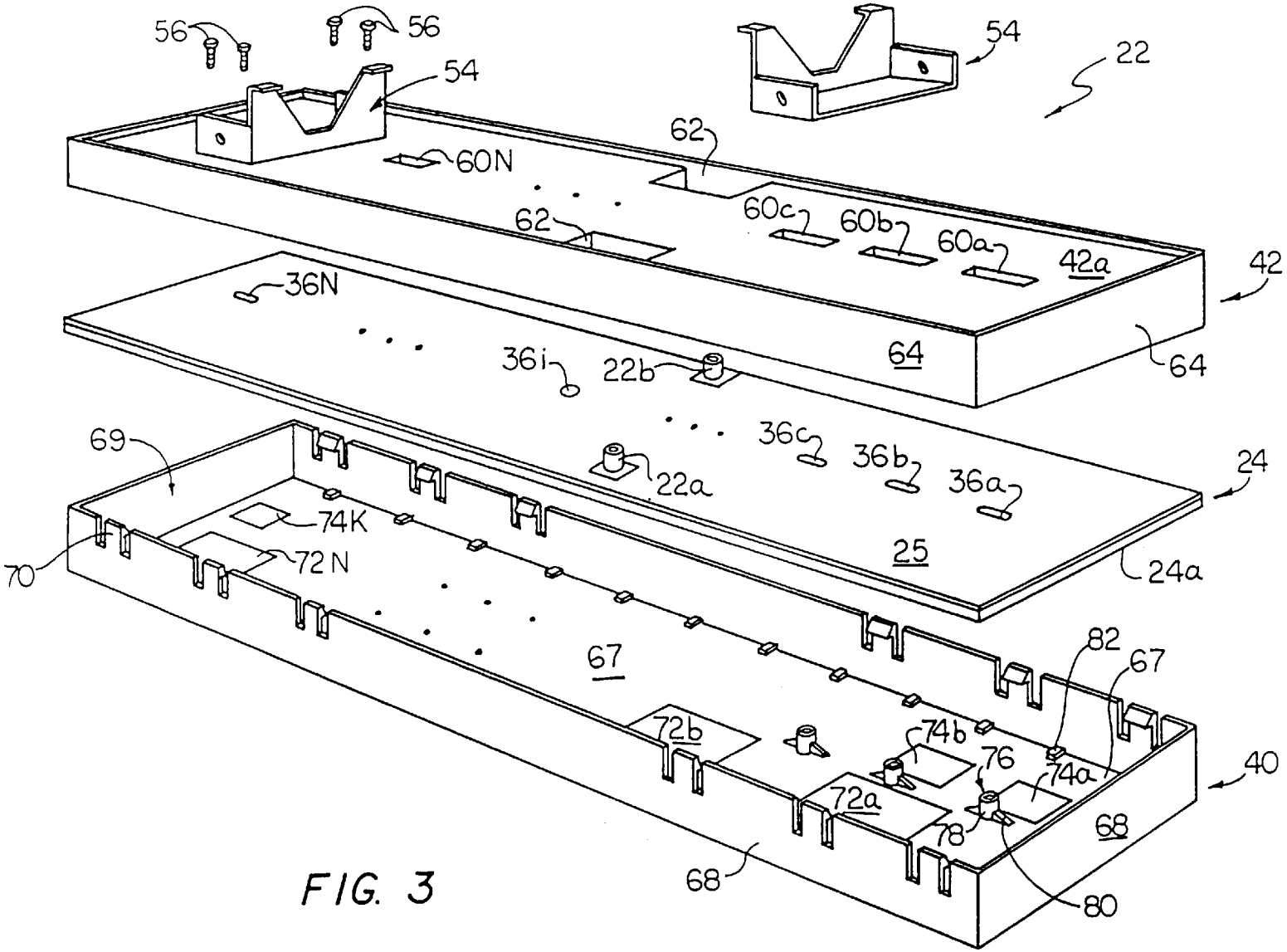
FIG. 3, is an exploded view of the antenna assembly in FIG. 2.

Referring now to FIGS. 2 and 3 in which like elements are provided having like reference designations a dual band antenna assembly 22 which may be similar to antennas 12 described above in conjunction with FIG. 1, includes a substrate 24 having first and second opposing surfaces 24*a*, 24*b*. The substrate 24 is provided having a thickness T here corresponding to about 0.060 inches and a relative dielectric constant $\in_r$ typically of about 3.2. In particular, substrate 24 may be provided as the type manufactured by Taconics Corporation, Coonbrook Road, Petersburgh, N.Y. and identified as part no. TLC-32. Portions of substrate 24 have here been removed to reveal a ground plane conductor 25 disposed over substrate surface 24*b*.

A first plurality of strip conductors 26*a*–26N generally denoted 26 having a length $L_1$ and a width $W_1$ are disposed over the substrate surface 24*a* to provide a plurality of radiating antenna elements 26 which form an array 27 of antenna elements 26. Each of the strip conductors 26 may be provided having a rectangular shape or alternatively strip conductors 26 may be provided having a square shape with sides having equal lengths $L_1$.

A radio frequency (RF) feed circuit 28 has an input port 28*a* coupled to an antenna input port 22*a* (FIG. 3). Input port 22*a* is here provided as an N-type flange connector mounted on ground plane conductor 25 in a manner which is generally known. Those of ordinary skill in the art will appreciate that other connector types may also be used.

Feed circuit 28 also includes a plurality of output ports each of which is coupled to a corresponding one of the antenna elements 26*a*–26N as shown. Feed circuit 28 may be provided, for example, from a plurality of strip conductors disposed on the first surface 24*a* of substrate 24 and coupled to a first side of the radiating elements 26. Although feed circuit 28 is here shown as strip conductors disposed on substrate 24, those of ordinary skill in the art will appreciate, of course, that other types of feed circuits such as probe feed circuits or capacitive feed circuits may also be used to couple RF energy to and from the radiating elements 26 and that such feed circuits may or may not include microstrip or other printed circuits.

A second plurality of strip conductors 30*a*–30K generally denoted 30 are disposed on the surface 24*a* of substrate 24 to provide a plurality of radiating elements which form an array 32 of antenna elements 30. Each of the strip conductors 30 is provided having a rectangular shape with a length $L_2$ and a width $W_2$. Alternatively, strip conductors 30 may be provided having a square shape with sides having equal lengths $L_2$ .

A radio frequency (RF) feed circuit 34 has an input port 34*a* coupled to an antenna input port 22*b* (FIG. 3) here provided as an N-type flange connector mounted on ground plane conductor 25 in a manner which is generally known. Feed circuit 34 also includes a plurality of output ports each of which is coupled to a corresponding one of the antenna elements 30*a*–30N as shown. Feed circuit 34 may be provided from a plurality of strip conductors disposed on the first surface 24*a* of substrate 24 and coupled to a first side of the radiating elements 30. Those of ordinary skill in the art will appreciate, of course, that other feed circuits such as probe feed circuits or capacitor feed circuits may also be used to couple RF energy to and from the radiating elements 30 and that such feed circuits may or may not include microstrip or other printed circuits.

Substrate 24 has provided therein a plurality of relief holes 36*a*–36N, generally denoted 36. Relief holes 36 are provided having an oval shape with a major axis aligned with a central longitudinal axis of the substrate 24. A center one of relief holes 36 is provided having a circular shape rather than an oval shape to thus serve as an alignment hole to thus align the substrate 36 with the radome 40. The oval relief holes 36 were selected to account for expansion in the longitudinal and transverse directions of the substrate 24. Since the substrate 24 is longer than it is wide, it is necessary to allow for a greater expansion in the longitudinal direction than the transverse direction.

Disposed over the surface 24*a* of substrate 24 is a radome 40 and disposed over surface 24*b* of substrate 24 is a back structure 42. Back structure 42 is provided having an egg crate surface 43 formed by a plurality of longitudinal and transverse directed back structure support walls 44 which intersect to form a plurality of void regions 46. Formed along a central longitudinal axis of back structure 42 are a plurality of stand-off-feed-through structures 48*a*–48N, generally denoted 48. Each of the feed through structures 48 has an opening 50 provided therein. When substrate 24 is placed against back structure 42, the openings 50 are aligned with the relief holes 36. In this particular embodiment, the openings 50 and relief holes 36 are aligned along a central longitudinal axis of the substrate 24 and back structure 42, respectively.

Back structure 42 also has provided therein a pair of connector access openings 52 which accept antenna connectors 22*a*, 22*b* when substrate 24 is disposed against the back structure support walls 44.

Referring briefly to FIG. 3, a second surface 42*a* of back structure 42 has a plurality of mounting brackets 54 disposed thereon. Mounting brackets 54 are secured to the back structure 42 via fasteners such as screws 56. Mounting brackets 54 secure antenna system 22 to a mounting structure such as a pole 58 only a portion of which is here shown for clarity.

Back structure 42 has provided in the second surface 42*a* thereof a plurality of fastener access openings 60*a*–60K generally denoted 60. Also, provided in the second surface of back structure 42 are a pair of connector access openings 62 through which signal cables (not shown) are disposed and coupled to connectors 22*a*, 22*b*. Portions of walls 64 protrude above back structure surface 42*a* to form a continuous edge 66 around the perimeter of back structure 42.

Radome 40 has a base region 67 with a plurality of side wall regions 68 projecting therefrom to form a recessed region 69 in the radome 40. The radome side walls 68 include a plurality of clips 70. In this particular embodiment, the clips are formed as an integral part of the radome 40. In other embodiments the clips may be provided separately from radome 40 and coupled to radome 40. When back structure 42 is placed against ground plane 25 and radome 40 is placed over substrate surface 24*a*, clips 70 engage the edge region 66 of back structure 42 to provide an enclosed antenna assembly 22. Clips 70 may be positioned along any of sides 68*a*–68*d* as required to ensure a secure engagement with back structure 42.

Figure 3A:
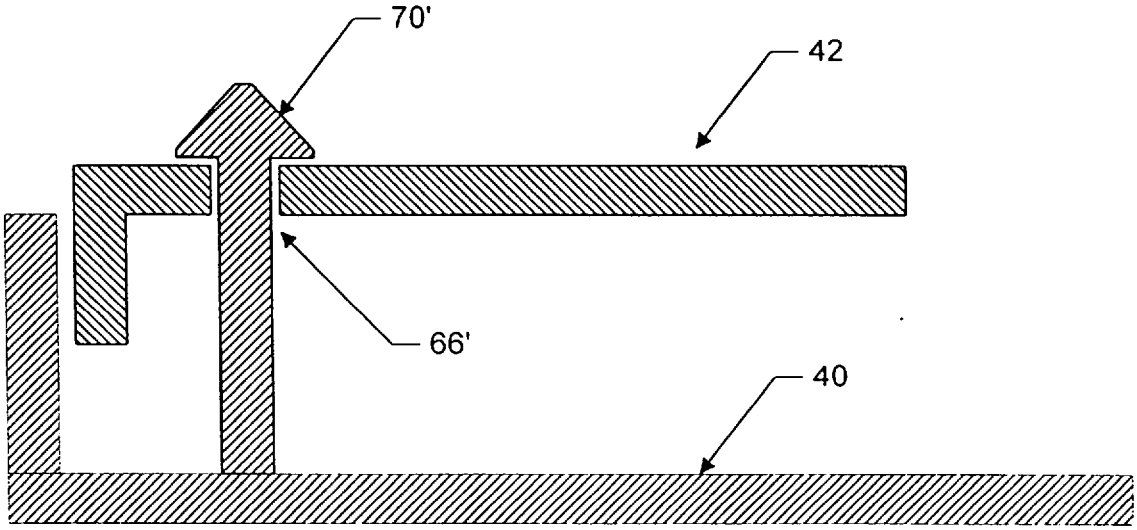
FIG. 3A is a cross sectional view of a mounting plug.

Referring briefly to FIG. 3A, radome 40 may be secure to backstructure 42 by engaging an engagement head 70' through an aperture 66' provided in backstructure 42. Engagement structures 66', 70' may be disposed around the perimeter of the backstructure 42 and radome 40 respectively.

Referring again to FIG. 3, disposed on base region 67 are a first plurality of strip conductors 72*a*–72N which form parasitic antenna elements. Also disposed on base region 67 are a second plurality of strip conductors 74*a*–74N which form a second set of parasitic antenna elements. Projecting from base 67 are a plurality of stand-offs 76. Each of the stand-offs 76 include a post 78 and a mounting wing 80. The stand-offs 76 are positioned on based 67 such that they are aligned with relief holes 36 and backstructure openings 50 (FIG. 2) and thus in this particular embodiment the stand-offs 76 are positioned along a central longitudinal axis of radome 40. A plurality of stiffeners 82 project from an internal surface of the side wall regions 68 of radome 40 onto base region 67 to provide additional support to side walls 68. Stiffeners 82 also contact substrate 24 and minimize the amount by which substrate 24 can move when covered by radome 40 and backstructure 42.

To assemble the antenna 22, connectors 22*a*, 22*b* are attached to substrate 24 and in particular a central probe of each of the connectors 22*a*, 22*b* is coupled to a respective one of the feed circuits 28, 34 (FIG. 2). Substrate 24 is then placed over the stand-offs 76 such that antenna elements 26, 30 disposed on surface 24*a* (FIG. 2) of substrate 24 are spaced a pre-determined distance from the parasitic antenna elements 72, 76 disposed on the surface of the base region 67. The particular manner in which the antenna elements 26, 30, 72, 76 are spaced will be described further below in conjunction with FIG. 4. Suffice it here to say, that a surface of each of the mounting wings 80 contact substrate surface 24*a* to control the spacing of the substrate above the radome.

When the substrate 24 is disposed on stand-offs 76, posts 78 project through the openings 36. Mounting wings 80 and stiffeners 82 minimize the amount by which substrate 24 is able to move along transverse and longitudinal directions.

Next, the back structure 42 is disposed over the substrate 24 such that the posts 78 project into openings 60*a*–60N. Similarly, connectors 22*a*, 22*b* project into respective ones of connector access openings 62.

The back structure 42 is fabricated having tolerances which ensure that the substrate 24 is secured in place when the back structure is disposed thereover and coupled to radome 40. The back structure 42 may be manufactured, for example, from a structural foam such as the type manufactured by Nory Corporation and identified as part number FN150. Nory FN150 structural foam is an injection molded self-foaming plastic Thus, this particular material allows back structure 42 to be fabricated using injection molding techniques. Those of ordinary skill in the art will appreciate of course, that other materials having similar mechanical characteristics may also be used and that back structure 42 may be fabricated using manufacturing techniques other than injection molding techniques.

As mentioned above, radome clips 70 engage edges 66 and thus antenna 22 may be assembled without the aid of screws or other hardware including assembly tools. Optionally, however, in addition to clips 70, nylon screws may be inserted through openings 36 to engage threaded holes in mounting posts 78. Alternatively still, post 78 may be provided having a glue or epoxy top which may be melted and re-cured to fasten the antenna back structure 42 to the antenna radome 40 thereby ensuring that the substrate 24 remains enclosed.

Radome 40 may be provided using injection molding or any other techniques which may be used to fabricate relatively inexpensive structurally sound radomes. Radome 40 may be manufactured, for example, from a plastic such as the type manufactured by Cycoloy Corporation and identified as part number C2950 which is a Acrylonitrile Butadiene Styrene Polycarbonate (i.e. an ABS/PC blend). This material is an alloyed plastic having the processing capabilities of ABS as well as the mechanical properties, including impact and heat resistance of polycarbonate. Several important characteristics of this material include low electrical loss to RF signals propagating at desired antenna operating frequencies, relatively high impact resistance, and dimensional stability upon exposure to environmental conditions. Furthermore this material is, flame retardant and paintable. Those of ordinary skill will appreciate, of course, that other materials having similar mechanical and electrical characteristics may also be used. The coefficient of thermal expansion of the materials used to provide both the radome 40 and back structure 42 are preferably selected to be similar to thus reduce stress on the antenna assembly 22 upon exposure of the antenna assembly 22 to extremely low and extremely high temperatures.

When fabricating radome 40, the parasitic antenna elements 72, 74 may be deposited on the base region 67 using decals having copper patterns printed thereon. The decals may be melted, molded or otherwise embedded into base 67 of radome 40. A thin layer of plastic may be disposed over the parasitic elements 72, 74 to prevent damage to elements 72, 74 during assembly and also to prevent elements 72, 74 from being lifted from the base region 67 of the radome 40. Such a protective layer may be provided having a thickness typically of about 0.005 inches.

Figure 4:
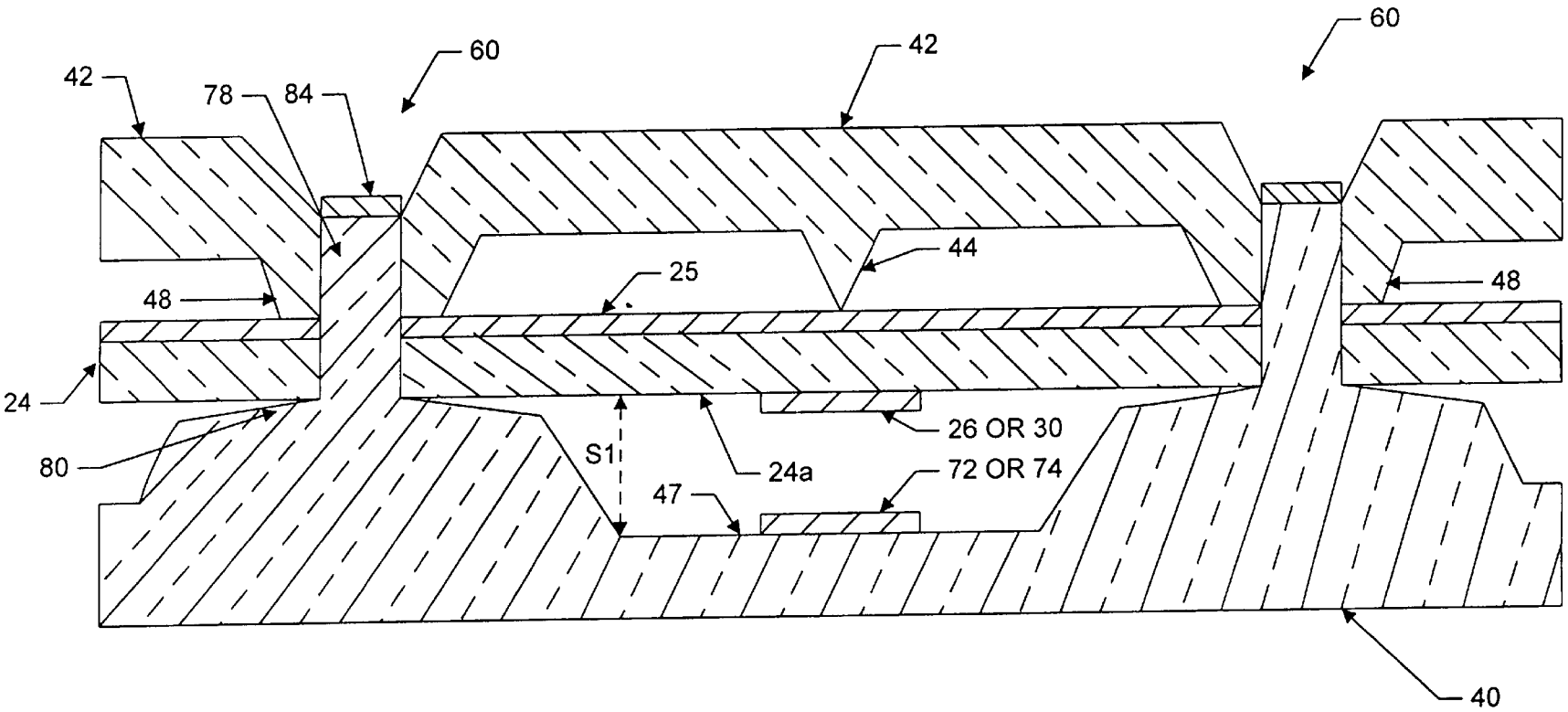
FIG. 4, is a cross-sectional view of an antenna assembly.

Referring now to FIG. 4, in which like elements of antenna 22 described above in conjunction with FIGS. 2 and 3 are provided having like reference designations, a portion of the antenna 22 is shown assembled. The first surface 24*a* of substrate 24 is disposed against a first surface of mounting wing 80. As mentioned above, when antenna 22 is assembled, substrate 24 is also supported by support blocks 82 (FIG. 3). A fastener 84 which may be provided as a plastic screw, epoxy joint or the like, coupled to the end of post 78 secures post 78 and thus radome 40 to the back structure 42.

Back structure support walls 44 as well as portions of stand-off feed through structures 48 contact ground plane 25 thereby securing the substrate 24 between the back structure and mounting wings 80. Mounting wings 80 space the antenna elements 26 and 30 from parasitic elements 72 and 74 by a pre-determined distance S1. The distance S1 may thus be adjusted by selecting stand-offs 76 having different height mounting wings 80.

Figure 5:
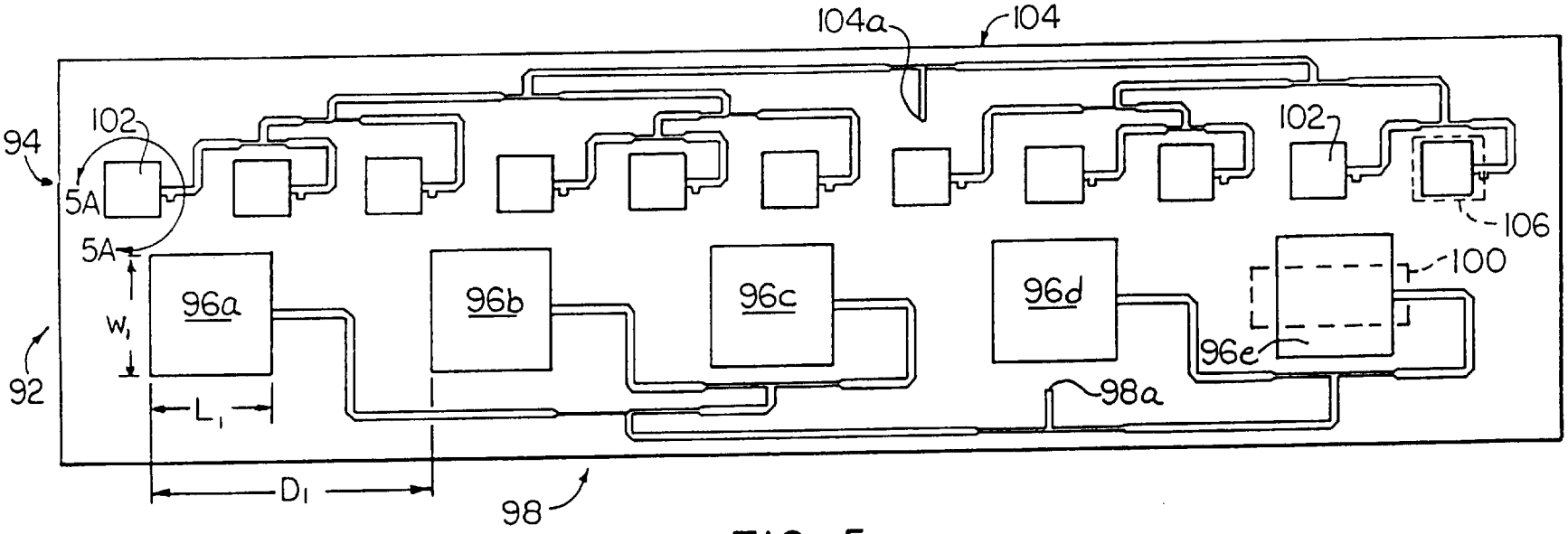
FIG. 5, is a plan view of a dual band antenna.
Figure 5A:
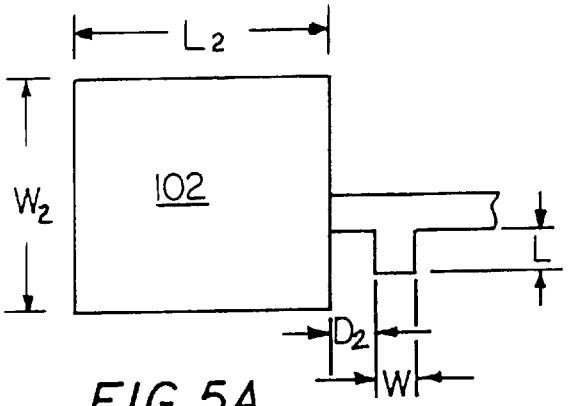
FIG. 5A is an enlarged view of a portion of the antenna in FIG. 5.

Referring now to FIGS. 5 and 5A antenna 90 includes first and second nested linear arrays 92, 94. In this particular embodiment, array 92 includes five antenna elements 96*a*–96*e*. A feed circuit 98 is here provided from four power divider circuits. An inport port 98*a* of feed circuit of 98 is coupled to an antenna input connector such as input connector 22*a* described above in conjunction with FIG. 3. The impedance characteristics of the individual transmission lines which form the four power divider circuits are selected to provide predetermined power division between the port 98*a* and each of the ports which are coupled to antenna elements 96 and also to provide an impedance match to the antenna elements 96. Here the impedance characteristics and lengths of the individual transmission lines which form the four power divider circuits are selected such that a signal fed to port 98*a* is results in equal amplitude equal phase signals being presented at each of remaining ports of power divider circuit 98.

For operation in the 900 MHZ frequency range, antenna elements 96 are provided having a length $L_1$ typically of about 3.660 inches and a width $W_1$ typically of about 3.614 inches and are disposed on a first surface of a substrate having a thickness typically of about 0.060 inches and a relative dielectric constant typically of about 3.2. A ground plane conductor is disposed on a second opposing surface of the substrate. Each of the elements 96*a*, 96*b* are spaced by a distance D1 corresponding to about 8.453 inches.

Disposed over each of the antenna elements 96 is a corresponding parasitic antenna element 100 which may be similar to parasitic element 72*a* described above in conjunction with FIGS. 3–4. Parasitic elements 100 are provided having a length of typically of about 4.8 inches and a width typically of about 2.22 inches and are centrally disposed over corresponding ones of antenna elements 96 as shown. When parasitic elements 100 are disposed on an inner surface of a radome as described above in conjunction with FIG. 3, the relative dielectric constant of the radome should typically be about 2.7 and the radome should be provided having a thickness typically of about 120 inches. Parasitic elements 100 are spaced above antenna elements 96 by a distance (designated $S_1$ in FIG. 4) typically of about 1.5 inches.

Antenna array 94 includes eleven radiating elements 102, each of the radiating elements 102 having a square shape. For operation in the 1900 MHZ frequency range, the radiating elements 102 are provided having a length typically of about 1.701 inches and a width typically of about 1.701 inches. A feed circuit 104 is here provided from ten power divider circuits coupled as shown. An input port 104*a* of feed circuit 104 is coupled to an antenna input port such as input port 22*b* described above in conjunction with FIG. 3. The impedance characteristics of the individual transmission lines which form the four power divider circuits are selected to provide predetermined power division between the port 98*a* and each of the ports which are coupled to antenna elements 96 and also to provide an impedance match to the antenna element 102. Here the impedance characteristics and lengths of the individual transmission lines which form the four power divider circuits are selected such that a signal fed to port 98*a* is results in equal amplitude equal phase signals being presented at each of remaining ports of power divider circuit 98. Each of the feed lines coupled to antenna elements 102 includes a tuning circuit 105.

Referring briefly to FIG. 5A, tuning circuit 105 improves the impedance match between power divider circuit 104 and antenna element 102. In this particular embodiment, the tuning circuit 105 is provided having a length L typically of about 0.180 inches and a width W typically of about 0.200 inches and a first edge of the tuning circuit 105 is spaced a distance D2 typically of about 0.140 inches from a first edge of the antenna element 102.

Referring again to FIG. 5, a parasitic antenna element 106 is disposed over each of the radiating elements 102. In this particular embodiment, each of the parasitic elements 106 are provided having a length measured along a longitudinal axis of the antenna typically of about 2.18 inches and a width typically of about 1.90 inches. One parasitic element 106 is centrally positioned as shown above a corresponding one of the plurality of radiating elements 102.

The width of the parasitic antenna elements 100, 106 may be adjusted to adjust the beamwidth of the antenna arrays 92, 94. The output ports of feed circuit 104 each include a tuning stub which minimizes impedance mismatches between feed circuit 104 and each of the antenna elements. Such impedance mismatches are due to mutual coupling between each of the antenna elements 102. In this particular embodiment, the matching structure is provided placing a tuning stub having a width typically of about 0.2 inches and a length typically of about 0.1 inches, a distance of about 0.140 inches from a first edge of the antenna element 102. In this manner, an impedance match is achieved between the feed circuit 104 and the radiating antenna elements 102. The spacing between a longitudinal axis along which antenna elements 96 lie and a longitudinal axis along which antenna elements 102 lie is typically of about 3.80 inches.

Those of ordinary skill in the art will appreciate, of course, that more or fewer than five antenna elements 96 may be used in array 92 and that more or fewer than eleven antenna elements 102 may be used in array 94. The number of elements used in each of the array 92 and 94 is dictated by the available antenna aperture size, the desired operating frequencies and the desired beamwidth. In this particular embodiment, the antenna arrays 92, 94 are responsive to RF signals having linear vertical polarization however, the feed structures and shapes of the antenna elements may be changed such that arrays 92, 94 are responsive to signals having other antenna polarizations. For example, antenna arrays 92, 94 may be provided from microstrip patches having a circular shape.

Although arrays 92, 94 have here been described for operation in the 800–900 MHz frequency ranges, those of ordinary skill in the art will appreciate that the length, width and spacing of the antenna elements 96, 102 and parasitic antenna elements 100, 106 as well as the distance $S_1$ by which the parasitic elements 100, 106 are spaced from the antenna elements 92, 94 may be selected using iterative empirical techniques to allow antenna 90 to operate at frequencies other than frequencies in the 800–900 MHz and 1900 MHz frequency ranges. To provide antenna 90 as a low cost printed circuit antenna, the microstrip antenna elements and feed circuits may be manufactured by providing a substrate having double sided one-half once (oz) copper disposed on first and second opposing surfaces thereof and using well known subtractive material processes such as etching to provide antenna elements and feed circuits on substrate 24. Those of ordinary skill in the art will recognize, of course, that instead of subtractive processes well known additive processes such as pattern plating may also be used to provide the antenna elements and feed circuits. In this case, substrate 24 would be provided having copper or some other conductor disposed on only one side thereof and copper or some other conductor is disposed on the conductor free surface of the substrate.

In a subtractive process, the strip conductors which provide antenna elements 96, 102 and feed circuits 98, 104 are provided by depositing a photo-resist layer (not shown) over the conductor layer (not shown) on a first surface of the substrate and patterning the photo-resist layer to selectively mask portions of the conductor layer corresponding to the strip conductors comprising the transmission line sections and transmission line resonators shown in FIG. 5. A chemical etchant, such as a combination of sulfuric and hydrochloric acid, is brought into contact with unmasked portions of the conductive layer to remove such unmasked conductor portions while leaving strip conductors which form the antenna elements 96, 102 and transmission line transmission line sections which make up the power divider circuits 98, 104 described above. The conductive layer on the second surface of the substrate provides the ground plane 25 (FIG. 3) to the substrate.

Alternatively, the strip conductors which provide antenna elements 96, 102 and feed circuits 98, 104 could be provided by the so-called "lift off" or pattern plating technique. In the lift off technique, the substrate has a conductive layer disposed only on a second surface thereof to act as the ground plane to the substrate. A patterned photo-resist layer is provided over a first surface of the substrate and a conductive layer is deposited over the photo-resist and exposed portions of the first surface of the substrate provided by the patterned layer. The photo-resist is then "lifted off" carrying away the metal deposited thereon but leaving behind the metal deposited on the substrate and thus providing the patterned strip conductors as shown in FIG. 5.

Figure 6:
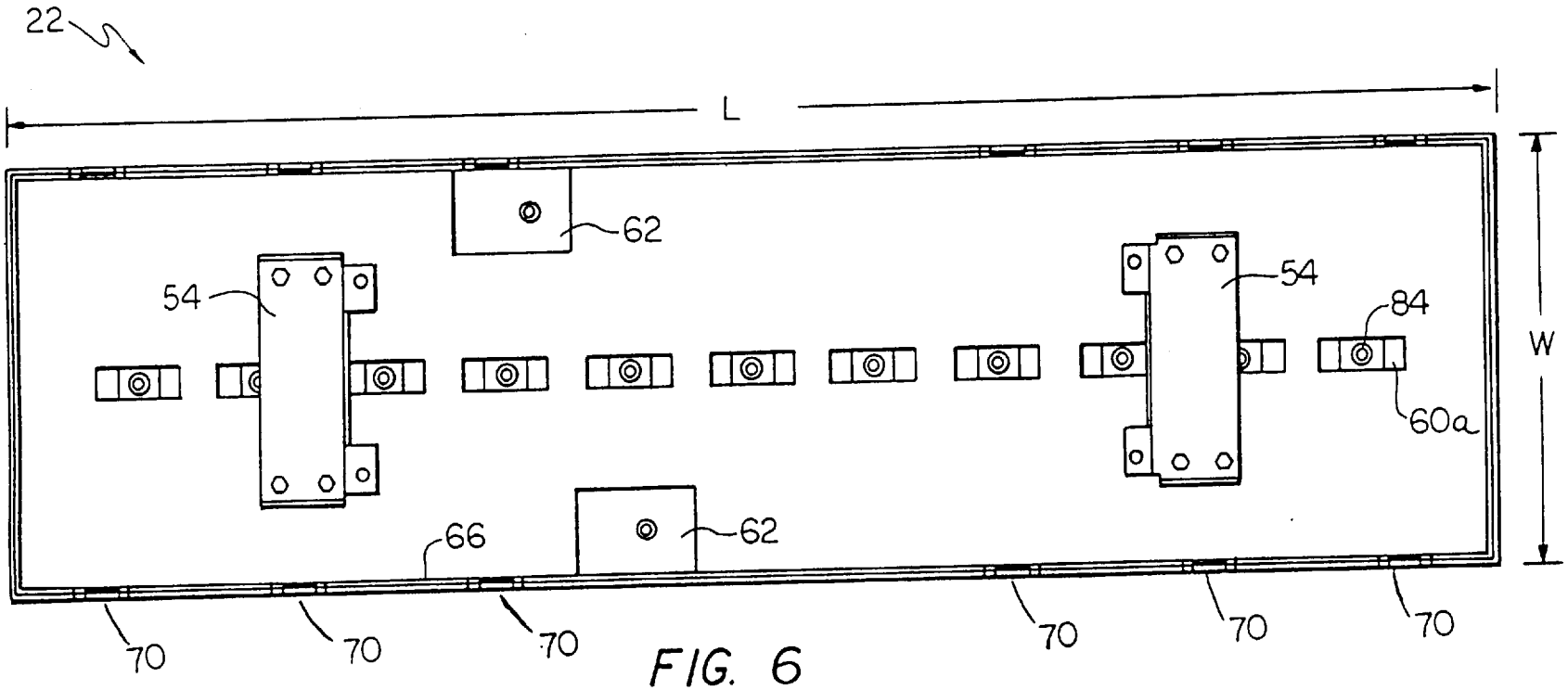
FIG. 6, is a top view of an antenna assembly.
Figure 6A:
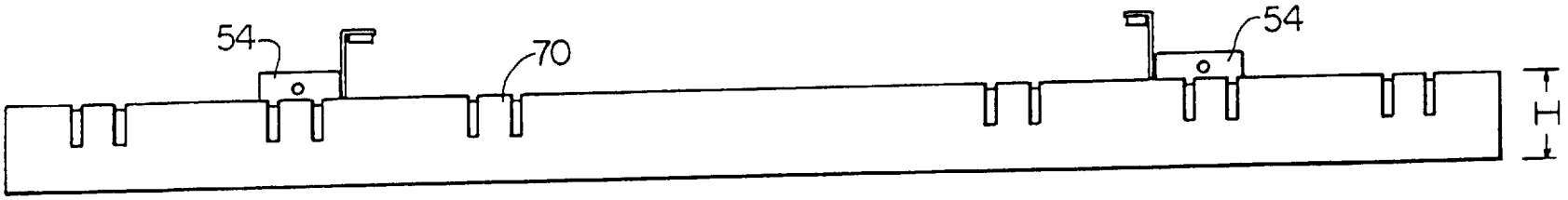
FIG. 6A, is a side view of an antenna assembly.

Referring now to FIGS. 6 and 6A in which like elements of FIGS. 2–4 are provided having like reference designations, assembled antenna 22 is shown having an overall length L typically of about 46 inches, an overall width W typically of about 12.5 inches and an overall height H (FIG. 6A) typically of about 2.67 inches. Clips 70 engage back structure edge 66 to thus provide an antenna assembly 22 which does not require mechanical fasteners. Furthermore, the antenna may be environmentally sealed by applying a sealant such as a silicone caulking material or a gasket manufactured from appropriate materials to the seam formed from backstructure edge 66 and radome walls 68.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

We claim:

1. An antenna having first and second antenna ports, the antenna comprising:

a substrate having a first surface with a ground plane disposed over at least a portion thereof and having a second surface;

a first plurality of strip conductors disposed along a first longitudinal axis of the second surface of said substrate, each of said first plurality of strip conductors having a first shape;

a first feed circuit having a first port coupled to a first one of the first and second antenna ports and having a plurality of second ports, each of the second ports coupled to one of said first plurality of strip conductors;

a second plurality of strip conductors disposed along a second different longitudinal axis of the second surface of said substrate, each of said second plurality of strip conductors having a second shape;

a second feed circuit having a first port coupled to a second one of the first and second antenna ports and having a plurality of second ports, each of the second ports coupled to one of said second plurality of strip conductors;

a radome having first and second opposing surfaces with the first surface of said radome disposed over and spaced a predetermined distance from the second surface of said substrate with the spacing between the first surface of said radome and the second surface of said substrate filled with air;

a third plurality of strip conductors disposed on the first surface of said radome, above the first plurality of strip conductors; and a fourth plurality of strip conductors disposed on the first surface of said radome, above the second plurality of strip conductors.

2. The antenna of claim 1 wherein:

said third plurality of strip conductors are disposed on the first surface of said radome along a first longitudinal axis of the first surface of said radome wherein the first longitudinal axis of the first surface of said radome is aligned with the first longitudinal axis of the second surface of said substrate; and said fourth plurality of strip conductors are disposed on the first surface of said radome along a second longitudinal axis of the first surface of said radome wherein the second longitudinal axis of the first surface of said radome is aligned with the second longitudinal axis of the second surface of said substrate.

3. The antenna of claim 2 wherein:

said first plurality of strip conductors are provided having a first rectangular shape;

said second plurality of strip conductors are provided having a second rectangular shape;

said third plurality of strip conductors are provided having a third rectangular shape; and said fourth plurality of strip conductors are provided having a fourth rectangular shape wherein the length of each of said third plurality of strip conductors along the first longitudinal axis of the first surface of said radome is greater than the length of said first plurality of strip conductors along the first longitudinal axis of the second surface of said substrate and the length of each of said fourth plurality of strip conductors along the first longitudinal axis of the first surface of said radome is greater than the length of said second plurality of strip conductors along the first longitudinal axis of the second surface of said substrate.

4. The antenna of claim 3 further comprising a back structure disposed over the first surface of said substrate such that at least a portion of a first surface of said back structure contacts the first surface of said substrate and wherein said back structure is coupled to a first one of said radome and said substrate.

5. The antenna of claim 4 wherein said radome comprises clips which engage a first edge of said back structure.

6. The antenna of claim 5 wherein the first surface of said back structure is provided having an egg crate shape.

7. The antenna of claim 6 wherein:

said substrate is provided having a plurality of holes therein;

said back structure is provided having a like plurality of holes therein, each of the holes in the back structure aligned with a corresponding one of the holes in said substrate;

said spacers project from a first surface of said radome through the holes in said substrate and into the holes in said back structure; and means, coupled to the spacer, for securing the radome to the back structure.

8. The antenna of claim 7 wherein said means for securing is provided as a first one of:

a fastener; and a glue joint.

9. An antenna having first and second antenna ports, the antenna comprising:

a radome having a top surface, a bottom surface and an outer side surface;

a clip coupled to said radome said clip having an outer surface which is flush with the outer side surface of said radome, and an inner surface from which a boss projects;

a substrate having a first surface with a ground plane disposed over at least a portion thereof and having a second opposing surface;

a first plurality of strip conductors disposed along a first longitudinal axis of the second surface of said substrate, each of said first plurality of strip conductors having a first rectangular shape;

a first feed circuit having a first port coupled to a first one of the first and second antenna ports and having a plurality of second ports, each of the second ports coupled to one of said first plurality of strip conductors;

a support plate having first and second opposing surfaces, a pair of side edges and a pair of end edges with a distance from one of the edges selected such that when said radome is disposed over said substrate and said support plate, the boss projecting from the inner surface of said clip engages at least one of the pair of side edges of said support plate to secure said radome to said support plate.

10. The antenna of claim 9 further comprising:

a second plurality of strip conductors disposed along a second different longitudinal axis of the second surface of said substrate, each of said second plurality of strip conductors having a second rectangular shape; and a second feed circuit having a first port coupled to a second one of the first and second antenna ports and having a plurality of second ports, each of the second ports coupled to one of said second plurality of strip conductors.

11. The antenna of claim 9 wherein said support plate comprises:

a base portion;

side wall portions projecting from the base portion, the sidewall portions defining an interior region of said support plate;

a first plurality of support walls projecting from the base portion in the interior region of said support plate with a first edge of each of said support walls disposed against the first surface of said substrate.

12. The antenna of claim 11 wherein said clip receiver is provided as a first one of:

an aperture in the base portion of said support plate; and an edge of the sidewall portions of said support plate.

13. The antenna of claim 12 wherein:

said first and second plurality of strip conductors are provided having a square shape.

14. The antenna of claim 13 wherein said first feed circuit comprises:

a first power divider circuit having a first port coupled to the first antenna port and having second and third ports;

a second power divider circuit having a first port coupled to the first port of said first power divider circuit and having second and third ports;

a third power divider circuit having a first port coupled to the second port of said first power divider circuit and having second and third ports;

a fourth power divider circuit having a first port coupled to the second port of said second power divider circuit, having a second port coupled to a first one of said first plurality of strip conductors and having a third port;

a fifth power divider circuit having a first port coupled to the third port of said second power divider circuit, having a second port coupled to a second one of said first plurality of strip conductors and having a third port;

a sixth power divider circuit having a first port coupled to the second port of said third power divider circuit, having a second port coupled to a third one of said first plurality of strip conductors and having a third port;

a seventh power divider circuit having a first port coupled to the third port of said third power divider circuit, having a second port coupled to a fourth one of said first plurality of strip conductors and having a third port coupled to a fifth one of said first plurality of strip conductors;

an eighth power divider circuit having a first port coupled to the third port of said fourth divider circuit, having a second port coupled to a sixth one of said first plurality of strip conductors and having a third port coupled to a seventh one of said first plurality of strip conductors;

a ninth power divider circuit having a first port coupled to the third port of said fifth power divider circuit, having a second port coupled to an eighth one of said first plurality of strip conductors and having a third port coupled to a ninth one of said first plurality of strip conductors; and a tenth divider circuit having a first port coupled to the third port of said sixth power divider circuit, having a second port coupled to a tenth one of said first plurality of strip conductors and having a third port coupled to an eleventh one of said first plurality of strip conductors.

15. The antenna of claim 14 wherein said second feed circuit comprises:

a first power divider circuit having a first port coupled to the second antenna port and having second and third ports;

a second power divider circuit having a first port coupled to the first port of said first power divider circuit, having a second port coupled to a first one of said second plurality of strip conductors and having a third port;

a third power divider circuit having a first port coupled to the second port of said first power divider circuit, having a second port coupled to a second one of said second plurality of strip conductors and having a third port coupled to a third one of said second plurality of strip conductors;

a fourth power divider circuit having a first port coupled to the second port of said second power divider circuit, having a second port coupled to a fourth one of said second plurality of strip conductors and having a third port coupled to a fifth one of said second plurality of strip conductors.

16. The antenna of claim 15 wherein each of said first, second and third power divider circuits are provided as a plurality of strip conductors disposed over the first surface of said substrate.

17. The antenna of claim 13 wherein:

said first feed circuit includes a power divider circuit having a first input port and a plurality of output ports, each of the output ports coupled to a corresponding one of the plurality of square strip conductors, wherein in response to an input signal being fed to the input port of said power divider circuit, said power divider provides an output signal at each of the output ports wherein each output signal is provided having a substantially like amplitude and phase; and said second feed circuit includes a power divider circuit having a first input port and a plurality of output ports, each of the output ports coupled to a corresponding one of the plurality of square strip conductors, wherein in response to an input signal being fed to the input port of said power divider circuit, said power divider provides an output signal at each of the output ports wherein each output signal is provided having a substantially like amplitude and phase.

* * * * *

UNITED STATES PATENT AND TRADEMARK OFFICE

CERTIFICATE OF CORRECTION

PATENT NO : 5,841,401

DATED : November 24, 1998

INVENTOR(S) : Bodley et al.

It is certified that error appears in the above-identified patent and that said Letters Patent are hereby corrected as shown below:

On title page, item [75], line 3, delete "Pramingham" and replace with --Framingham--.

Col. 3, line 52, delete "12a-2c" and replace with --12a-12c--.

Col. 5, line 46, delete "60a-60K" and replace with --60a-60n--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*